US006225272B1

(12) United States Patent
Giesen et al.

(10) Patent No.: US 6,225,272 B1
(45) Date of Patent: May 1, 2001

(54) DISHWASHING DETERGENT WITH ENHANCED CLEANING EFFECT

(75) Inventors: Brigitte Giesen, Duesseldorf; Dagmar Zaika, Mettmann; Birgit Middelhauve, Monheim; Rainer Hofmann, Duesseldorf; Dieter Legel, Solingen, all of (DE)

(73) Assignee: Henkel Kommanditgesellsehaft auf Aktien, Duesseldorf (DE)

( * ) Notice: Subject to any disclaimer, the term of this patent is extended or adjusted under 35 U.S.C. 154(b) by 0 days.

(21) Appl. No.: 09/254,609

(22) PCT Filed: Nov. 12, 1997

(86) PCT No.: PCT/EP97/06313

§ 371 Date: Jul. 9, 1999

§ 102(e) Date: Jul. 9, 1999

(87) PCT Pub. No.: WO98/21300

PCT Pub. Date: May 22, 1998

(30) Foreign Application Priority Data

Nov. 12, 1996 (DE) ..... 196 46 520

(51) Int. Cl.[7] ..... C11D 3/10; C11D 3/60; C11D 17/00

(52) U.S. Cl. ..... 510/236; 510/235; 510/237

(58) Field of Search ..... 510/235, 405, 510/407, 414, 426, 432, 470, 490, 509, 535, 236, 237, 340, 341

(56) References Cited

U.S. PATENT DOCUMENTS

| | | | | |
|---|---|---|---|---|
| 3,981,826 | | 9/1976 | Munro | 252/526 |
| 4,051,055 | | 9/1977 | Trinh et al. | 252/95 |
| 4,179,414 | | 12/1979 | Clayton | 252/548 |
| 4,438,016 | | 3/1984 | Kiewert et al. | 252/174.25 |
| 4,797,231 | | 1/1989 | Schumann et al. | 252/547 |
| 5,286,406 | * | 2/1994 | Scholz et al. | 252/174.17 |
| 5,480,586 | * | 1/1996 | Jakubicki et al. | 252/545 |
| 5,565,146 | * | 10/1996 | Jakubicki et al. | 510/235 |
| 5,627,144 | * | 5/1997 | Urfer et al. | 507/211 |
| 5,658,875 | * | 8/1997 | Giesen et al. | 510/470 |
| 5,663,137 | * | 9/1997 | Giesen et al. | 510/470 |
| 5,688,930 | * | 11/1997 | Bertho et al. | 536/18.6 |
| 5,756,442 | | 5/1998 | Jeschke et al. | 510/236 |
| 5,773,595 | * | 6/1998 | Weuthen et al. | 536/17.9 |
| 5,789,372 | * | 8/1998 | Fabry | 510/502 |
| 5,858,299 | * | 1/1999 | Fernholz et al. | 264/414 |

FOREIGN PATENT DOCUMENTS

| | | |
|---|---|---|
| 42 34 487 | 4/1994 | (DE) . |
| 42 19 287 | 12/1994 | (DE) . |
| 0 110 106 | 6/1984 | (EP) . |
| 0 193 375 | 9/1986 | (EP) . |
| 0 199 195 | 10/1986 | (EP) . |
| 0 334 566 | 9/1989 | (EP) . |
| 0 502 030 | 9/1992 | (EP) . |
| WO90/04630 | 5/1990 | (WO) . |
| WO91/08282 | 6/1991 | (WO) . |
| WO91/13959 | 9/1991 | (WO) . |
| WO94/16042 | 7/1994 | (WO) . |

* cited by examiner

*Primary Examiner*—Yogendra Gupta
*Assistant Examiner*—John M. Petruncio
(74) *Attorney, Agent, or Firm*—Connolly Bove Lodge &Hutz LLP

(57) ABSTRACT

A pourable, storage-stable manual dishwashing detergent is provided. The detergent contains at least 45 percent sodium bicarbonate with a mean particle diameter of at least 150 micrometers. The sodium bicarbonate is combined with an anionic surfactant, an alkyl polyglycoside surfactant, a zwitterionic surfactant an electrolyte and optionally a solvent, to form the detergent. The detergent of the invention has good pouring properties and excellent cleaning performance against dried-on and burnt-on soil.

29 Claims, No Drawings

DISHWASHING DETERGENT WITH ENHANCED CLEANING EFFECT

BACKGROUND OF THE INVENTION

This invention relates to dishwashing detergents with enhanced cleaning power, particularly against dried-on and burnt-on soil, consisting of a surfactant mixture and water-soluble abrasive components.

If conventional manual dishwashing detergents are used in attempts to remove dried-on and burnt-on soil, the performance limit of the products is soon encountered. Now, the problem addressed by the present invention was to formulate a manual dishwashing detergent which would contain a soluble abrasive component in addition to the surfactant mixtures otherwise typical of this group of products. When used in a concentrated formulation, this component would facilitate the removal of obstinate soils. When used after dilution, the product would have the performance profile of high-quality manual dishwashing detergents.

DISCUSSION OF RELATED ART

Detergents containing soluble abrasive components are known from the prior art. According to U.S. Pat. No. 4,179,414 (Mobil Oil), a paste containing 50 to 65% by weight of sodium bicarbonate is used for cleaning hard surfaces. U.S. Pat. No. 3,981,826 (Procter & Gamble) describes a water-soluble, non-aqueous, liquid, paste-form or gel-form abrasive detergent composition containing a dispersion of a water-miscible liquid medium with a solid, water-soluble anionic surfactant and, in addition, a solid, particulate, water-soluble inorganic salt stabilized with a suspending agent.

According to U.S. Pat. No. 4,051,055 (Procter & Gamble), up to 50% by weight of sodium bicarbonate is used as a buffer reagent or detergent builder for a cleaning composition for cleaning porcelain or enamel surfaces, the composition additionally containing hypochloride, a fluoride salt and day with cation-exchanging properties.

International patent application WO 90/04630 (Henkel Corporation) claims an aqueous composition for the spray-drying of detergents which contains 8 to 25% by weight of surfactants, 25 to 60% by weight of sodium carbonate, 10 to 40% by weight of a builder component, 15 to 35% by weight of sodium sulfate, 0.5 to 5% by weight of additives, 0.5 to 10% by weight of alkyl polyglycoside and 0.5 to 10% by weight of sodium chloride.

European patent application EP 110 106 (Henkel) describes aqueous, storage-stable, liquid or paste-form cleaning or scouring compositions with stable active ingredients which contain from 0 to 60% by weight and preferably 10 to 50% by weight of an abrasive component with a particle size of 1 to 200 micrometers ($\mu$m).

European patent EP 193 375 (Unilever) describes a pourable, homogeneous, abrasive cleaning composition for hard surfaces which, in addition to a surfactant, is said essentially to contain a water-soluble salt in quantities above its saturation limit, the undissolved particles of this salt having a temporary abrasive effect. Sodium bicarbonate is preferably used. Undissolved abrasive particles can only be introduced into these cleaning compositions for hard surfaces in quantities of up to 45% by weight.

European patent EP 334 566 (Unilever) describes pourable, homogeneous aqueous detergent compositions containing a water-soluble abrasive component which at least partly contains sodium sulfate and which is suitable for manual dishwashing. The composition is said to be self-thickening, i.e. not to require the addition of thickeners, and to contain at least 30 to 89.5% by weight and preferably 45 to 70% by weight of water. The compositions are said to have an apparent viscosity at 20° C. of at least 6,500 Pas at a shear rate of $3\times10^{-5}$ $s^{-1}$ and no more than 10 Pas at a shear rate of 21 $s^{-1}$.

European patent EP 502 030 (Unilever) claims a shear-diluting, liquid scouring composition with a pH value of 7 to 13 which contains more than 10% by weight of water, 1.5 to 30% by weight of a detergent active compound, more than 45% by weight and up to 75% by weight of sodium bicarbonate in the form of undissolved particles with a certain volume particle diameter of less 80 micrometers, a certain particle diameter distribution range of 1 to 3 and an apparent viscosity of at least 400 Pas at a shear rate of $3\times10^{-5}$ $s^{-1}$ and at a temperature of 20° C. and an apparent viscosity of no more than 10 Pas at 21 $s^{-1}$/20° C.

However, none of the compositions proposed in the prior art is suitable as a high-performance, dermatologically compatible, temperature- and storage-stable, pourable and ecologically particularly safe manual dishwashing detergent which is capable of removing obstinate soil, which contains large water-soluble abrasive components, for example at least 150 micrometers ($\mu$m) and preferably 200 micrometers in diameter, and which can be produced without any problems.

Relatively voluminous abrasive components have the advantage of an improved cleaning effect against burnt-on soil, but are attended by the disadvantage of relatively poor suspendability in concentrated form and, along with that, poor stability in storage.

Further improved cleaning performance against burnt-on soil is obtained where relatively large quantities of sodium bicarbonate are used as the water-soluble abrasive component (for example more than 45% by weight). If quantities as large as these are incorporated in the surfactant mixtures typical of this class of detergents, i.e. surfactant mixtures of anionic surfactants, such as fatty alcohol ether sulfate or fatty alcohol sulfate, nonionic surfactants, such as alkyl polyglycoside, and zwitterionic surfactants, for example betaines, the products obtained are often highly viscous, poorly soluble and difficult to dose. If additional solvents are used to reduce viscosity, the stability of the dispersion in storage deteriorates, often dramatically, so that stable, high-performance manual dishwashing detergents containing large, solid, water-soluble abrasive components in large quantities cannot be produced from the information available in the prior art.

DESCRIPTION OF THE INVENTION

Storage-stable products with good pouring properties and excellent cleaning performance against dried-on and burnt-on soil, coupled with very favorable properties when used in dilute form, are obtained by incorporating a mixture of fatty alcohol ether sulfate, optionally fatty alcohol sulfate, alkyl polyglycoside and betaine together with sodium bicarbonate having an average particle diameter of more than 150 micrometers, preferably 200 micrometers, as water-soluble abrasive component and an electrolyte, such as sodium chloride or magnesium chloride, and a polyol system.

Accordingly, the present invention relates to a manual dishwashing detergent containing anionic surfactants, alkyl polyglycosides and betaine surfactants and between 46 and 50% by weight of sodium bicarbonate with a mean particle diameter of more than 150 micrometers ($\mu$m), preferably 200 micrometers, as water-soluble abrasive component and an additional electrolyte, preferably between 0.5 and 10% by weight, and 0 to 5% by weight and preferably 0.5 to 5% by weight of solvent preferably selected from polyethylene glycols.

Anionic surfactants suitable for use in accordance with the present invention are aliphatic sulfates, such as fatty alcohol sulfates, fatty alcohol ether sulfates, dialkyl ether sulfates, monoglyceride sulfates, and aliphatic sulfonates, such as alkane sulfonates, olefin sulfonates, ether sulfonates, n-alkyl ether sulfonates, ester sulfonates and lignin sulfonates. Fatty acid cyanamides, sulfosuccinic acid esters, fatty acid isethionates, acyl aminoalkane sulfonates (fatty acid taurides), fatty acid sarcosinates, ether carboxylic acids and alkyl (ether)phosphates may also be used in accordance with the invention.

Fatty alcohol ether sulfates are particularly preferred for the purposes of the present invention. Fatty alcohol ether sulfates are products of sulfation reactions with alkoxylated alcohols. Alkoxylated alcohols are generally understood among experts to be the reaction products of alkylene oxide, preferably ethylene oxide, with alcohols, relatively long-chain alcohols being preferred for the purposes of the invention. In general, a complex mixture of addition products differing in their degrees of ethoxylation is formed from n moles of ethylene oxide and 1 mole of alcohol, depending on the reaction conditions. Another embodiment comprises using mixtures of alkylene oxides, preferably a mixture of ethylene oxide and propylene oxide. Fatty alcohols with a low degree of ethoxylation (1 to 4 EO, preferably 2 EO) are most particularly preferred for the purposes of the invention. Fatty alcohol ether sulfates are preferably used in quantities of 0.2 to 29.7% by weight, preferably 5 to 25% by weight and more preferably 10 to 20% by weight.

The anionic surfactants are preferably used in quantities of 1 to 30% by weight, although quantities of up to 45% by weight may also be used, for example where it is preferred to use fatty alcohol sulfates. Fatty alcohol sulfates are preferably used in quantities of 0.5 to 15% by weight in addition to other anionic surfactants.

Nonionic surfactants in the context of the present invention include alkoxylates, such as polyglycol ethers, fatty alcohol polyglycol ethers, alkyl phenol polyglycol ethers, end-capped polyglycol ethers, mixed ethers and hydroxy mixed ethers, and fatty acid polyglycol esters. Ethylene oxide, propylene oxide, block polymers and fatty acid alkanolamides and fatty acid polyglycol ethers may also be used. An important class of nonionic surfactants which may be used in accordance with the invention are the polyol surfactants, particularly glucosurfactants, such as alkyl polyglucoside and fatty acid glucamides. Alkyl polyglucosides are particularly preferred.

Alkyl polyglycosides are surfactants which may be obtained by reacting sugars and alcohols by the relevant methods of preparative organic chemistry. A mixture of monoalkylated, oligomeric or polymeric sugars is obtained according to the method of production. Preferred alkyl polyglycosides include alkyl polyglucosides; in a particularly preferred embodiment, the alcohol is a long-chain fatty alcohol or a mixture of long-chain fatty alcohols with branched or unbranched alkyl chain lengths of $C_8$ to $C_{18}$ and the degree of oligomerization of the sugars is between 1 and 10.

In a particularly preferred embodiment, the alkyl polyglycosides are used in quantities of 0.1 to 14.9% by weight, preferably in quantities of 1 to 8% by weight and more preferably in quantities of 1.0 to 4.0% by weight.

The zwitterionic surfactants or amphosurfactants which may be used in accordance with the invention include alkyl betaines, alkyl amidobetaines, imidazolinium betaines and aminopropionates and also sulfobetaines and biosurfactants.

These zwitterionic surfactants are preferably used in quantities of 0.1 to 14.9% by weight, more preferably in quantities of 1 to 8% by weight and most preferably in quantities of 1.0 to 4.0% by weight. Surfactants are preferably used in quantities of 0.4 to 30% by weight in the dishwashing detergent.

Examples of solubilizers, for example for dyes and perfume oils, include alkanolamines, polyols, such as ethylene glycol, propylene glycol, 1,2-glycerol and other monohydric and polyhydric alcohols and alkyl benzenesulfonates containing 1 to 3 carbon atoms in the alkyl group. However, preferred constituents for the purposes of the present invention are also polyethylene glycols with molecular weights of up to 20,000. They are preferably used in quantities of 0 to 5% by weight and more preferably in quantities of 0.5 to 5% by weight.

Favorable viscosities for the compositions according to the invention at a temperature of 20° C. are in the range from 1,000 to 10,000 mPas, preferably in the range from 2,500 to 10,000 mPas and more preferably in the range from 3,000 to 7,000 mPas (shear rate 10 $s^{-1}$) or in the range from 500 to 5,000 Pas (shear rate 30 $s^{-1}$).

Preferred zero shear viscosity values $\eta_c$ for favorable storage properties are in the range from 1,000 to 10,000 Pas and preferably in the range from 1,000 to 5,000 Pas.

In order to control viscosity, it has proved to be useful to add an electrolyte, for example sodium chloride. In most cases, a surprising reduction in viscosity is observed. The most favorable quantities of sodium chloride for the purposes of the invention are between 6 and 8% by weight. Where the compositions are produced on a relatively large scale, for example on an industrial scale, rheopexic behavior can be observed in certain compositions. In other words, the mixtures thicken on prolonged exposure to shear forces which might not be desirable. If, in this case, the additional electrolyte is changed, this behavior can be reduced. If magnesium chloride, for example, is used, for example in the form of its hexahydrate, thixotropic behavior can even be observed. Excellent results are obtained with quantities of 0.5 to 10% by weight, preferably 1 to 5% by weight and, more preferably, 1.5 to 4% by weight of magnesium chloride.

Other ingredients typical of manual dishwashing detergents, such as for example defoamers (silicone oils, paraffin oils or mineral oils), solvents (for example alcohols), thickeners (for example natural or synthetic polymers), structurants, perfume oils, dyes, corrosion inhibitors, preservatives or the like, may also be present in the quantities of up to 5% by weight typically encountered in manual dishwashing detergents.

EXAMPLES

I. Influence of Variation of the Sodium Chloride, Sodium Bicarbonate and Polydiol Contents Rheological measurements were carried out to demonstrate the particular advantages of pourability despite a high solids content, stable suspendability despite voluminous particles and temperature-dependent stability in storage.

Flow tests were carried out with a Rheometrics RFS II shear-rate-controlled rotational rheometer with a plate/plate measuring system (2 mm gap) to determine the shear-ratedependent viscosity $\eta$ in addition to the zero shear viscosity $\eta_0$. In addition, dynamic strain-sweep experiments provide values for the viscoelasticity (elasticity modulus G' and loss moduls G") and the yield point $\tau_F$ at room temperature. Besides the variations in composition, Table 1 below shows the viscosities $\eta$ at the shear rates 0 $s^{-1}$, 10 $s^{-1}$ and 30 $s^{-1}$, the elasticity or storage modulus G', the viscosity or loss modulus G", the ratio G'/G" as a measure of the degree of viscoelasticity and the yield point $\tau_F$.

The following exemplary starting formulation I was investigated:

13.5% by weight Texapon® N 70 ($C_{12/14}$ fatty alcohol ether 2 EO sulfate)

1.3% by weight Dehyton® SPK/OKA (cocoamidopropyl betaine)

2% by weight APG® 600 UP W (alkyl polyglucoside—$C_{12}/C_{16}$ alkyl chain)

0.01 % by weight silicone defoamer 0.37% by weight perfume

The variable parameters of this formulation were as follows:

4 to 6% by weight Polydiol® 300 (polyethylene glycol, average molecular weight 300)

4 to 10% by weight NaCl 46 to 52% by weight sodium bicarbonate (BiCa) rest water.

TABLE I

| Mixture | $\tau_F$ | G' | G" | | $\eta$ (10 $s^{-1}$) | $\eta$ (30 $s^{-1}$) | $\eta_0$ | Composition | | |
|---|---|---|---|---|---|---|---|---|---|---|
| No. | [Pa] | [Pa] | [Pa] | G'/G" | [Pas] | [Pas] | [Pas] | NaCl | BiCa | Polydiol |
| 3 | 0.1 | 24 | 50 | 0.48 | 0.56 | 0.6 | 20 | 4 | 46 | 4 |
| 4 | 19 | 320 | 72 | 4.44 | 4.7 | 2.4 | 1020 | 6 | 46 | 4 |
| 5 | 10.5 | 350 | 62 | 5.6 | 4.7 | 2.6 | 1500 | 8 | 46 | 4 |
| 6 | 7.7 | 320 | 67 | 4.8 | 2.6 | 1.5 | 1010 | 10 | 46 | 4 |
| 15 | 1.5 | 100 | 87 | 1.14 | 2.3 | 1.5 | 260 | 4 | 48 | 4 |
| 16 | 9.9 | 450 | 90 | 5 | 4.3 | 2.3 | 1300 | 6 | 48 | 4 |
| 17 | 7.3 | 270 | 55 | 4.9 | 4.4 | 2.6 | 1400 | 8 | 48 | 4 |
| 18 | 10 | 500 | 98 | 5.1 | 5.5 | 3.2 | 2000 | 10 | 48 | 4 |
| 27 | 7.9 | 610 | 170 | 3.6 | 9.7 | 5.9 | 1600 | 4 | 50 | 4 |
| 28 | 10.4 | 400 | 77 | 5.2 | 4.6 | 2.6 | 1700 | 6 | 50 | 4 |
| 29 | 28 | 1400 | 270 | 5.2 | 5.5 | 3.2 | 2400 | 8 | 50 | 4 |
| 30 | 20 | 870 | 46 | 18.9 | 9.9 | 5.3 | 5000 | 10 | 50 | 4 |
| 39 | 8 | 520 | 130 | 4 | 8.9 | 5 | 1700 | 4 | 52 | 4 |
| 40 | 12 | 420 | 72 | 5.8 | 5.7 | 3.3 | 2600 | 6 | 52 | 4 |
| 41 | 24 | 1000 | 160 | 6.3 | 9.2 | 4.9 | 5000 | 8 | 52 | 4 |
| 42 | 28 | 2000 | 430 | 4.6 | 14 | 7.1 | 3700 | 10 | 52 | 4 |
| 45 | 5.2 | 370 | 170 | 2.2 | 1.5 | 1.7 | 50 | 4 | 52 | 6 |
| 46 | 6.8 | 260 | 76 | 3.4 | 3.7 | 2.1 | 650 | 6 | 52 | 6 |
| 47 | 4.8 | 370 | 270 | 1.4 | 6.5 | 4.8 | 830 | 8 | 52 | 6 |
| 48 | 0.8 | 250 | 240 | 1 | 9.9 | 6.8 | 460 | 10 | 52 | 6 |

All samples (except for mixture No. 3) have the shear-diluting pseudoplastic flow behavior with yield point (i.e. viscosity decreases dramatically on shearing) favorable to pourability in use. As shearing diminishes, a generally high zero shear viscosity $\eta_0$ favorable for storage is present. All the dispersions show more or less viscoelastic behavior. In general, the Theological properties increase differently with increasing bicarbonate and sodium chloride contents and a given polydiol content. At 46 and 48% by weight sodium bicarbonate, the resulting viscosities and densities increase with increasing sodium chloride content and virtually reach saturation levels. At 50 and 52% sodium bicarbonate, high viscosities are reached through the increased solids content while density passes through a maximum. Without wishing to be restricted to any particular theory, applicants believe that a contributory factor in this regard could be the intensified dispersion of air. The effect of varying the quantity of sodium chloride is far weaker here. An increase from 4 to 6% for polyethylene glycol at 52% sodium bicarbonate to control viscosity results in more or less serious destabilization of the dispersions and reduction of the viscosities and densities. Particularly seriously destabilized systems, such as mixtures 3, 15, 45 and 46 for example, show signs of separation even during the rheological measurement under the influence of the acting shear forces.

Another important parameter for the evaluation of storage stability is the dependence of the measured values on temperature. Table II below shows the dependence on temperature of the Theological properties for a selected dispersion based on formulation I.

TABLE II

| | | | | | Temperature-dependent viscosity | | | | Composition | | |
|---|---|---|---|---|---|---|---|---|---|---|---|
| Temp. [° C.] | Yield point $\tau_F$ [Pa] | G' [Pa] | G" [Pa] | G'/G" | $\eta$ $10s^{-1}$ [pas] | $\eta$ $30s^{-1}$ [Pas] | $\eta_0$ $\eta_0$ [Pas] | $\gamma$ critical | % NaCl | % BiCa | % Polydiol 300 |
| 5° C. | 54.8 | 130 | 43 | 3 | 4.8 | 3.1 | 600 | 0.02 | 8 | 48 | 4 |
| 15° C. | 4 | 170 | 23 | 7.4 | 4 | 2.6 | 670 | 0.026 | 8 | 48 | 4 |

TABLE II-continued

| Temperature-dependent viscosity | | | | | | | | | Composition | | |
|---|---|---|---|---|---|---|---|---|---|---|---|
| Temp. [° C.] | Yield point $\tau_F$ [Pa] | G' [Pa] | G" [Pa] | G'/G" | $\eta$ $10s^{-1}$ [pas] | $\eta$ $30s^{-1}$ [Pas] | $\eta_0$ $\eta_0$ [Pas] | $\gamma$ critical | % NaCl | % BiCa | % Polydiol 300 |
| 25° C. | 7.3 | 270 | 55 | 4.9 | 4.4 | 2.6 | 1400 | 0.027 | 8 | 48 | 4 |
| 35° C. | 14.9 | 620 | 130 | 4.7 | 4.8 | 2.7 | 1400 | 0.024 | 8 | 48 | 4 |

It may be concluded from the foregoing data that very different influencing factors act on the pourability and product stability of suspended, abrasive water-soluble sodium bicarbonate particles with a mean particle diameter of more than 200 micrometers. Between 46 and 50% by weight sodium bicarbonate, a pourable and storage-stable product, of which the properties can be adjusted by adapting the polydiol content, can be obtained with 6 to 8% by weight of sodium chloride.

It was found in the course of the usual additional investigations that mixtures with sodium chloride show rheopexic behavior in some compositions.

Although increased sodium bicarbonate contents produce higher viscosity values, the variations in density occurring during the measurements suggest that problems would arise in practice.

Where surfactant mixtures based on starting formulation I above containing sodium bicarbonate were used, the use of magnesium chloride in quantities of 1% by weight and 2% by weight, but especially in quantities of 3 and 4% by weight, resulted in thixotropic behavior which, under certain conditions, can be very favorable for the production of large quantities of product. Where magnesium chloride is used, the composition of the mixture must be strictly observed because certain quantities could give rise to stability problems.

What is claimed is:

1. A pourable, storage-stable manual dishwashing detergent comprising:

(a) an anionic surfactant;

(b) an alkyl polyglycoside surfactant;

(c) a zwitterionic surfactant;

(d) greater than 45 percent by weight of sodium bicarbonate having a mean particle diameter of more than 150 micrometers;

(e) an electrolyte other than sodium bicarbonate; and (f) 0 to 6 percent by weight of a solvent.

2. The detergent of claim 1 comprising 1 to 45 percent by weight of the anionic surfactant.

3. The detergent of claim 2 comprising 1 to 30 percent by weight of the anionic surfactant.

4. The detergent of claim 1 wherein said anionic surfactant is 0.5 to 15 percent by weight of a fatty alcohol sulfate.

5. The detergent of claim 1 wherein the anionic surfactant comprises fatty alcohol ether sulfate.

6. The detergent of claim 5 comprising 0.2 to 29.7 percent by weight fatty alcohol ether sulfate.

7. The detergent of claim 6 comprising 5 to 25 percent by weight fatty alcohol ether sulfate.

8. The detergent of claim 7 comprising 10 to 20 percent by weight fatty alcohol ether sulfate.

9. The detergent of claim 1 comprising 0.1 to 14.9 percent by weight alkyl polyglycoside surfactant.

10. The detergent of claim 9 comprising 1 to 8 percent by weight alkyl polyglycoside surfactant.

11. The detergent of claim 10 comprising 1 to 4 percent by weight alkyl polyglycoside surfactant.

12. The detergent of claim 1 comprising 0.1 to 14.9 percent by weight zwitterionic surfactant.

13. The detergent of claim 12 comprising 1 to 8 percent by weight zwitterionic surfactant.

14. The detergent of claim 13 comprising 1 to 4 percent by weight zwitterionic surfactant.

15. The detergent of claim 1 wherein the zwitterionic surfactant comprises a betaine.

16. The detergent of claim 1 comprising 0.4 to 30 percent by weight of the sum of the anionic surfactant, the alkyl polycoside surfactant, and the zwitterionic surfactant.

17. The detergent of claim 1 wherein the sodium bicarbonate has a mean particle diameter of more than 200 micrometers.

18. The detergent of claim 1 comprising 46 to 52 percent by weight sodium bicarbonate.

19. The detergent of claim 18 comprising 46 to 50 percent by weight sodium bicarbonate.

20. The detergent of claim 1 comprising 0.5 to 10 percent by weight of the electrolyte.

21. The detergent of claim 1 wherein the electrolyte is sodium chloride.

22. The detergent of claim 21 comprising 6 to 8 percent by weight sodium chloride.

23. The detergent of claim 1 wherein the electrolyte is magnesium chloride.

24. The detergent of claim 23 comprising 1 to 5 percent by weight magnesium chloride.

25. The detergent of claim 24 comprising 1.5 to 4 percent by weight magnesium chloride.

26. The detergent of claim 1 comprising 0.5 to 5 percent by weight of the solvent.

27. The detergent of claim 8, wherein the solvent is a polyethylene glycol.

28. A pourable, storage-stable manual dishwashing detergent comprising:

a) 0.2 to 29.7 percent by weight of a fatty alcohol ether sulfate;

b) 0.1 to 14.9 percent by weight of an alkyl polyglycoside;

c) 0.1 to 14.9 percent by weight of a betaine;

d) 46 to 52 percent of sodium bicarbonate having a mean particle diameter of more than 150 micrometers;

e) 0.5 to 10 percent of an electrolyte other than sodium bicarbonate; and f) 0 to 5 percent by weight polyethylene glycol.

29. The pourable, storage-stable manual dishwashing detergent of claim 28 comprising:

a) 5 to 25 percent by weight of a fatty alcohol ether sulfate;

b) 1 to 8 percent by weight of an alkyl polyglycoside;

c) 0.5 to 8 percent by weight of a betaine;

d) 46 to 50 percent of sodium bicarbonate having a mean particle diameter of more than 200 micrometers;

e) 0.5 to 10 percent of sodium chloride or magnesium chloride;

f) 0.5 to 5 percent by weight polyethylene glycol.

* * * * *